US011167327B2

(12) United States Patent
Palmaz

(10) Patent No.: US 11,167,327 B2
(45) **Date of Patent: *Nov. 9, 2021**

(54) INJECTOR NEEDLE CLEANING APPARATUS AND METHOD

(71) Applicant: Bluebonnet Foods, L.P., San Antonio, TX (US)

(72) Inventor: Julio C. Palmaz, Napa, CA (US)

(73) Assignee: Bluebonnet Foods, L.P., San Antonio, TX (US)

( * ) Notice: Subject to any disclaimer, the term of this patent is extended or adjusted under 35 U.S.C. 154(b) by 28 days.

This patent is subject to a terminal disclaimer.

(21) Appl. No.: 16/725,180

(22) Filed: Dec. 23, 2019

(65) Prior Publication Data

US 2020/0215589 A1 Jul. 9, 2020

Related U.S. Application Data

(60) Continuation of application No. 16/524,632, filed on Jul. 29, 2019, now Pat. No. 10,512,951, which is a division of application No. 16/161,934, filed on Oct. 16, 2018, now Pat. No. 10,456,815.

(51) Int. Cl.

| | |
|---|---|
| ***B08B 9/032*** | (2006.01) |
| ***B08B 9/023*** | (2006.01) |
| ***B08B 9/00*** | (2006.01) |

(52) U.S. Cl.

CPC ..... *B08B 9/0321* (2013.01); *B08B 9/00* (2013.01); *B08B 9/023* (2013.01); *B08B 9/032* (2013.01); *B08B 9/0323* (2013.01); *B08B 2203/027* (2013.01); *B08B 2209/032* (2013.01)

(58) Field of Classification Search

CPC ..... B08B 9/00; B08B 9/023; B08B 9/032; B08B 9/0321; B08B 9/0323; B08B 2209/027; B08B 2209/032

See application file for complete search history.

(56) References Cited

U.S. PATENT DOCUMENTS

| | | | | |
|---|---|---|---|---|
| 3,718,083 | A | 2/1973 | Walters | 99/532 |
| 4,178,660 | A | 12/1979 | Olney et al. | 17/42.1 |
| 4,455,928 | A | 6/1984 | Townsend | 99/533 |
| 4,551,338 | A | 11/1985 | Wallace | 426/281 |
| 4,903,590 | A | 2/1990 | Muller et al. | 99/487 |
| 5,184,543 | A | 2/1993 | Victory | 99/533 |
| 5,275,095 | A | 1/1994 | Van Haren | 99/533 |
| 5,605,093 | A | 2/1997 | Higashimoto | 99/533 |
| 5,881,640 | A | 3/1999 | Raevsager | 99/533 |
| 5,913,968 | A | 6/1999 | Thomas | 99/533 |
| 6,014,926 | A | 1/2000 | Tanaka et al. | 99/487 |

(Continued)

*Primary Examiner* — Joseph L. Perrin

(74) *Attorney, Agent, or Firm* — David G. Rosenbaum; Rosenbaum IP. P.C.

(57) ABSTRACT

The present disclosure is a food injection needle cleaning system and method. The food injection needle cleaning system comprises a cleaning fluid tank coupled to high-pressure pump configured to pump cleaning fluid through at least one inlet, a channel, and at least one outlet of a food injection needle to dislodge and remove debris as well as sanitize the needle. The present disclosure comprises a high-pressure chamber configured to secure the food injection needle and seal around the needle such that fluid enters the needle through an inlet of the high-pressure chamber and exits the needle through a waste line.

11 Claims, 7 Drawing Sheets

(56) References Cited

U.S. PATENT DOCUMENTS

| | | | | |
|---|---|---|---|---|
| 6,386,099 | B1 | 5/2002 | Otsuka et al. | 99/487 |
| 6,405,646 | B2 | 6/2002 | Thomas | 99/533 |
| 6,439,112 | B1 | 8/2002 | Pope | 99/487 |
| 6,513,423 | B2 | 2/2003 | Thomas | 99/533 |
| 6,976,421 | B2 | 12/2005 | Hansen et al. | 99/487 |
| 7,481,156 | B2 | 1/2009 | Cozzini | 99/533 |
| 8,122,819 | B2 | 2/2012 | Hansen et al. | 99/487 |
| 2002/0195003 | A1 | 12/2002 | Backus et al. | 99/532 |
| 2003/0168082 | A1* | 9/2003 | Cundith | B08B 9/00 134/21 |
| 2005/0000550 | A1* | 1/2005 | Fick, Jr. | B08B 9/00 134/30 |
| 2005/0279227 | A1 | 12/2005 | Shroder | 99/532 |
| 2009/0032065 | A1* | 2/2009 | Bantz | G01N 35/1004 134/22.12 |
| 2010/0159090 | A1 | 6/2010 | Pedersen | 426/281 |
| 2013/0306117 | A1* | 11/2013 | Yamazaki | G01N 35/1004 134/171 |
| 2014/0272035 | A1 | 9/2014 | Estes et al. | B01D 29/6484 |
| 2015/0224549 | A1* | 8/2015 | Lagares Corominas | B08B 9/00 134/22.17 |

* cited by examiner

INJECTOR NEEDLE CLEANING APPARATUS AND METHOD

CROSS-REFERENCE TO RELATED APPLICATIONS

This application is a continuation of commonly assigned U.S. patent application Ser. No. 16/524,632, filed Jul. 29, 2019, now U.S. patent application Ser. No. 10/512,951; which is a divisional of U.S. patent application Ser. No. 16/161,934, filed Oct. 16, 2018, now U.S. patent application Ser. No. 10/456,815, and herein incorporated by reference in their entireties.

BACKGROUND OF THE INVENTION

The present invention relates generally to equipment and methods useful in food processing. More particularly, the present invention relates to a system, method, and apparatus for cleaning injector needles used for injecting substances, such as flavorings, tenderizers, preservatives or the like, into food products.

During food product processing, frequently fluid substances, such as flavorings, tenderizers, preservatives or the like, are injected into the food product. Such fluid substances are typically referred to in the art of food processing as "brine" or "pickle" and will be referred to herein as "fluid substances." Food products, such as vegetables, fruits, seafood, or meats, such as poultry, beef, pork, lamb or other meat products, for example, are frequently subjected to such processing prior to packaging for commercial sale. The process for injecting such fluid substances into the food product, typically entails using at least one hollow needle coupled to a source of the fluid substance and communicating the fluid substance from the source into and through the at least one hollow needle, which has penetrated the food product, and into the food product. The fluid substance may be a liquid, a slurry, a solution or a suspension of particulates, such as spices or flavoring agents, as is known in the art.

Food injector needles are typically tubular in shape and taper to a point at an injection end configured to penetrate into the food product. The needles generally comprise at least one fluid inflow port is disposed at a top portion or upper region of the needle, while at least one fluid outflow port is disposed at the injection end of the needle. As shown in U.S. Pat. No. 6,439,112, some needles have the fluid inflow port disposed through a sidewall of the needle at the upper region of the needle and additionally have the fluid outflow port disposed through a sidewall of the needle at a lateral lower region of the needle in proximity to the tapered point. A side outflow port allows for the best infiltration of the food product without creating fluid deposits in the product and resists being obstructed by the food product as the injector needle is inserted and withdrawn from the food product or by particulate matter in the fluid substance being injected.

Consumer kitchen flavor injection devices are typically single injection needles coupled to a liquid reservoir and a plunger or squeeze bulb such as that described in U.S. Pat. No. 4,178,660. In commercial food processing production lines, injector systems, like the ones taught in U.S. Pat. Nos. 4,455,928, 5,881,640, and 4,903,590 typically combine a plurality of injector needles, configured in an array, into an automated machine configured to inject the fluid substance into the food product simultaneously at multiple entry points in the food product. In some of these instances, the commercial injector systems include a conveyer belt or are part of a larger food processing line that moves the food product into position aligned with the hollow needle array, injects the food product with the fluid substance and, after injection, then conveys the food product further down the processing line for further processing.

Over time during use, the injection needles require clearing, such as clearing obstructions in the fluid flow path within the needle and need to be cleaned and/or sanitized. Mechanically, the needles may become obstructed with varying amounts of food product, particulates from the injected fluid substance or liquid residue. Similarly, because the injector needles are employed in raw meat processing, bacteria or other biological or chemical contaminants, will be transferred to the injector needles requiring the injector needles be sanitized. Further, the injector needs will need to be cleaned and/or sanitized when the food processing line changes to a different food being processed, for example, poultry to beef, or when the food processing line changes the fluid sub stance being injected.

Currently, it is known to remove the injector needles, either individually or as a connected array, from the injector machine, and manually wash the needles with a disinfecting or other cleaning solution, such as citric acid. Given that the bore diameters of injector needles are typically between about 1.6 to about 2.9 mm and bore lengths range from about 200 mm to about 365 mm, depending upon needle manufacturer, current methods of rapidly and effectively cleaning have been found to be ineffective and inefficient. For example, Inwestpol (Gdansk, Poland) makes an ultrasonic injector needle cleaner that requires individual needles be placed in a tray and the tray subjected to ultrasonic cleaning. (See, e.g., http://inwestpol.com/en/injectors/ultra-dzwiekowe-urzadzenie-do-czyszczenia-igiel-mt#3-gallery). Also, Metalquimia (Girona, Spain) makes an injector needle cleaning device (NEEDLECLEAN) in which individual needs or needle arrays are loaded into a machine having a reservoir or cleaning/disinfecting solution and over a period of 3.5 to 6 hours, the needles are cleaned. Promarksvac Corporation (Ontario, Canada) manufactures a line of fluid substance injectors that employ an air cleaning fixture (See, e.g., https://promarksvac.com/brine-injectors.html).

None of the conventional food injector systems or injector needle cleaning systems employ high-pressure, rapid cleaning and disinfecting capability that is capable of cleaning, disinfecting and/or clearing single injector needles, injector needle arrays either in-line with the fluid substance injector system or when the injector needles are removed from the fluid substance injector system. The present disclosure provides an apparatus and method addressing some of the shortcomings for cleaning, clearing and disinfecting injection needles that are found in the conventional food injector art.

SUMMARY OF THE INVENTION

The present disclosure is directed to a system and method for cleaning at least one food product injection needle. The system and method can be used to clean a single food injection needle or more than one food injection needle at a time. In one embodiment the cleaning system generally comprises a fluid tank and a high-pressure pump coupled to high-pressure chamber configured to secure and seal various portions of at least one food injection needle. The fluid tank contains a cleaning, disinfectant and/or clearing fluid, typically a liquid such as citric acid or a caustic such as NaOH. The fluid can be a detergent, an acid cleaner, a solvent cleaner, an abrasive cleaner, an antiseptic, a sanitizer, a germicide, a bactericide, a bacteriostat, or a combination thereof. The fluid is pumped from the fluid tank through the high-pressure chamber into the food injection needle, cleaning, sanitizing, and dislodging any debris within the needle.

One aspect of the disclosure comprises a food injection needle cleaning system comprising a power source and switch coupled to a solution pump, at least one cleaning fluid tank coupled to the solution pump configured to pump cleaning fluid through an inlet, a channel, and an outlet of the at least one food injection needle, a high-pressure chamber having a tubular bore fluidly coupled to the chamber fluid inlet port, the tubular bore having a first opening and a second opening, a needle receiver removably coupled to the first opening of the tubular bore and the second opening of the tubular bore being fluidly coupled to a waste line. The high-pressure chamber is configured to secure the at least one food injection needle and impart a seal around the at least one food injection needle when the needle receiver is depressed into the tubular bore, such that fluid enters the at least one food injection needle through an inlet of the high-pressure chamber and exits the at least one food injection needle through the waste line. The needle receiver, synonymously referred to as a "plunger," bears upon and compresses compressible seals within the tubular bore which, in turn seal about the injection needle. A substantially incompressible annular member is provided and positioned between first and second compressible annular members and forms a fluid flow space around the injection needle to permit fluid flow into and through the injection needle.

As used herein, the term "substantially," is intended to mean the quality or property that materially or completely is that which is specified.

In another aspect of the disclosure comprises a fluid tank coupled through a first fluid line to a low-pressure pump, such as, for example, a diaphragm pump, the low-pressure pump coupled through a second fluid line to a high-pressure pump, the high-pressure pump coupled to a high-pressure chamber through a high-pressure fluid line to the fluid inlet port of the high-pressure chamber. The high-pressure chamber generally comprises a housing having a central bore spanning its central longitudinal axis. The high-pressure chamber further comprises an assembly of a needle receiver having a central opening configured to fit a needle, a central opening configured to fit and retain a food injection needle, a first compressible annular member having an central bore configured to allow the food injection needle to pass there through, a substantially incompressible annular member having a central bore configured to allow the food injection needle to pass through the central bore, and a fluid opening fluidly coupled to the chamber fluid inlet and the needle fluid inlet, and at least one second compressible annular member having a central opening configured to accept the food injection needle therethrough. The central openings in each of the first compressible annular member, the substantially incompressible annular member and the second compressible annular member being in axial alignment with each other. The high-pressure chamber further comprises a press member, which may be manually, hydraulically or pneumatically actuated, bears upon and exerts pressure when actuated onto the needle receiver, which passes into the central bore of the high-pressure chamber and compresses the first and second compressible annular members against the food injection needle to create seals around the food injection needle, which leaving the central bore of the substantially incompressible annular member open to fluid flow into the food injection needle.

In another aspect of the disclosure, a method of use generally comprises cleaning fluid, including but not limited to citric acid, is pumped from the fluid tank either manually, electronically, or gravitationally from the fluid tank through a high-pressure pump and into the high-pressure chamber, the pressurized cleaning fluid is forced through the food injection needle fluid inlet port and out the injection needle fluid outlet port. The high-pressure flow of the cleaning fluid through the needle acts to disinfect the needle while dislodging any particles or debris into a waist line coupled to the chamber.

In another aspect of the disclosure the food injection needle cleaning system comprises a fluid tank having a fluid tank inlet and a fluid tank outlet, the fluid tank coupled to a fluid line, the fluid line coupled to a pump configured to pump fluid from the fluid tank through the fluid tank outlet to a second fluid line coupled to the pump, the second fluid line coupled to a high-pressure pump configured to pump fluid at increased pressure through a high-pressure fluid line coupled to a high-pressure chamber at a chamber fluid inlet port, the high-pressure chamber having a tubular bore fluidly coupled to the chamber fluid inlet port, a plunger inlet and a waste outlet, the high-pressure chamber further having an interior bottom surface shelf, a bottom compressible seal disposed within the tubular bore abutting the bottom surface shelf, the bottom compressible seal having a central opening configured to accommodate a food injection needle in a uncompressed state, and configured to form a seal around the food injection needle between a needle fluid inlet port of the food injection needle and a needle fluid outlet port of the food injection needle in a compressed state, a substantially incompressible annular member having a first opening, a second opening and a fluid inlet opening passing laterally through a wall of the substantially incompressible annular member. The substantially incompressible annular member is disposed within the tubular bore having a bottom surface abutting the bottom compressible seal, the fluid inlet of the substantially incompressible member is fluidly coupled to the chamber fluid inlet port and fluidly coupled to a needle fluid inlet port, a top compressible seal disposed within the tubular bore abutting a top surface of the substantially incompressible annular member, the top compressible seal having a central opening configured to accommodate a food injection needle in a uncompressed state, and seal around the food injection needle above the needle fluid inlet port of the food injection needle in a compressed state, a plunger having a tubular portion disposed with the tubular bore abutting a top surface of the top compressible seal and an annular portion disposed outside of the high-pressure chamber, the annular portion abutting a top surface of the high-pressure chamber in a compressed state, and having a gap between the top surface and the annular portion in an uncompressed state, a driver device configured to apply pressure to the plunger and compress the plunger into the plunger inlet in a first state and apply no pressure to the plunger in a second state, and a waste line coupled to the waste outlet configured to receive waste fluid and debris from a processed needle.

In another aspect of the disclosure the high-pressure chamber has at least a second tubular bore with at least a second plunger, at least a second top compressible seal, at least a second substantially incompressible annular member, at least a second bottom compressible seal, and a least a second chamber fluid inlet fluidly coupled to the at least second tubular bore and at least second substantially incompressible annular member. In this embodiment, at least a second high-pressure line may be coupled from the high-pressure pump to the at least second chamber fluid inlet. In alternative embodiments, with a similar configuration, the at least second chamber fluid inlet may be fluidly coupled to the first chamber fluid inlet and be configured to receive fluid from the single high-pressure line.

In another aspect of the disclosure the high-pressure chamber additionally comprises an O-ring positioned at a top surface of the high-pressure chamber surrounding the plunger inlet configured to form a seal between the plunger and the high-pressure chamber in a compressed state.

In another aspect of the disclosure at least one washer is disposed in any of the following places or combination thereof: between the plunger and the top compressible seal, between the top compressible seal and the substantially incompressible annular member, between the substantially incompressible annular member and the bottom compressible seal, between the bottom compressible seal and the bottom surface shelf.

In another aspect of the disclosure the bottom surface shelf is formed from an end cap having an opening coupled to a waste line that serves as a waste outlet from the high-pressure chamber.

In another aspect of the disclosure the high-pressure chamber additionally comprises an compressible seal, such as an O-ring, positioned at a bottom surface of the high-pressure chamber surrounding the waste outlet opening. The compressible seal is configured to form a seal between the end cap and the high-pressure chamber.

In another aspect of the disclosure the high-pressure pump comprises a pressure sensor coupled to a control system that is configured to limit the high-pressure pump from outputting a fluid pressure beyond a preset limit.

In another aspect of the disclosure a plurality of high-pressure chambers are coupled through a plurality of high-pressure fluid lines to the high-pressure pump in order to clean multiple needles at the same time.

In yet another aspect of the disclosure, a plurality of high-pressure chambers is coupled in parallel to a high-pressure pump or plural high-pressure pumps through a plurality of high-pressure fluid lines. The plurality of high-pressure fluid lines may be plural fluid conduits, or a single fluid conduit coupled to a manifold which, in turn, is coupled to plural high-pressure chambers. A single fluid tank or plural fluid tanks may be employed as the source of the cleaning, clearing and/or disinfecting fluid. This arrangement allows for cleaning of plurality needles simultaneously.

The methods, systems, and apparatuses are set forth in part in the description which follows, and in part will be obvious from the description, or can be learned by the practice of the methods, apparatuses, and systems. The advantages of the methods, apparatuses, and systems will be realized and attained by means of elements and combinations particularly pointed out in the appended claims. It is to be understood that both the foregoing general description and the following detailed description are exemplary and explanatory only and are not restrictive of the methods, apparatuses, and systems, as claimed. More details concerning these embodiments, and others, are further described in the following figures and detailed description set forth herein below.

BRIEF DESCRIPTION OF THE DRAWINGS

In the accompanying figures, like elements are identified by like reference numerals among the several preferred embodiments of the present disclosure.

While the invention has been described and disclosed in connection with various embodiments, it will be understood that the invention is capable of further modifications. This application is intended to cover any variations, uses or adaptations of the invention following, in general, the principles of the invention, and including such departures from the present disclosure as, within the known customary practice within the art to which the invention pertains.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1:
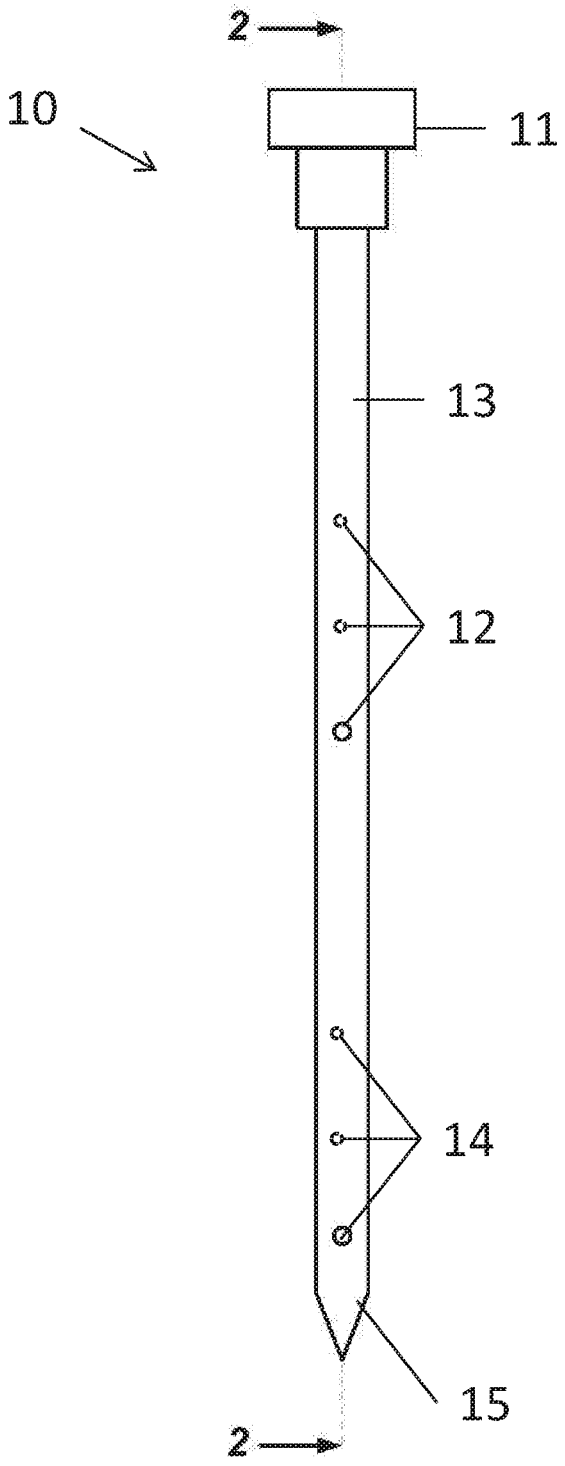
FIG. 1 shows an example embodiment of a food injection needle.
Figure 2:
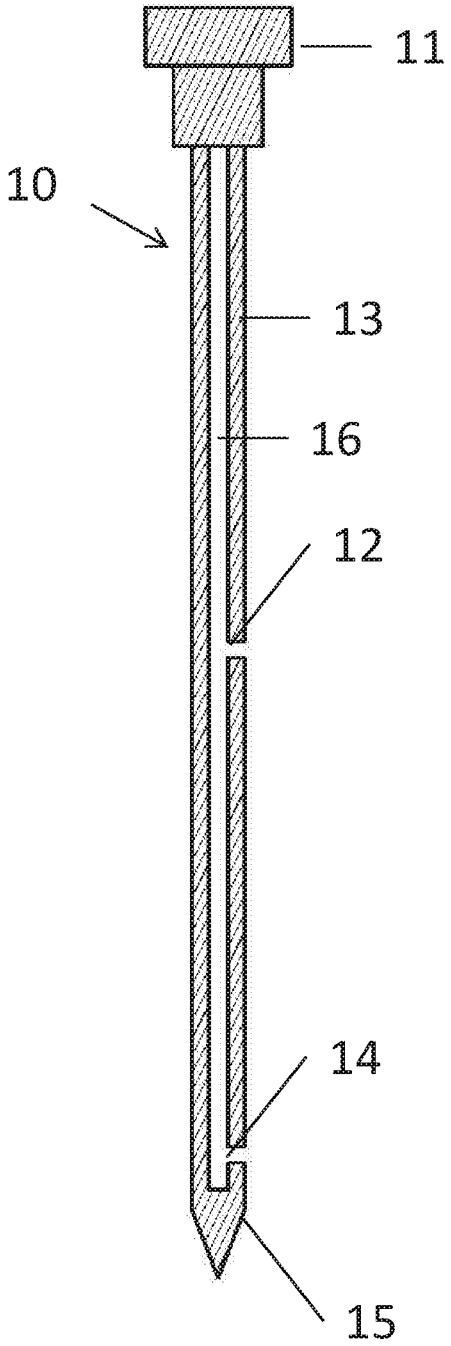
FIG. 2 shows a cross-sectional of the example embodiment of the food injection needle of FIG. 1.

FIGS. 1 and 2 show an example embodiment of a food injection needle 10 and a cross-section thereof. Injection needle 10 includes an upper needle seat 11, a needle shank 13, a fluid bore 16, and a tapered needle point 15 that penetrates into the food product being treated. At least one needle fluid inlet 12 passes laterally through the needle shank 13 and communicates with the fluid bore 16. At least one needle fluid outlet 14 is positioned in proximity to the tapered needle point 15 and communicates with the fluid bore 16 in proximity to the tapered needle point 15. The at least one needle fluid inlet 12 is preferably positioned toward the upper needle seat 11 and spaced apart from the at least one needle fluid outlet 14 a distance greater than a penetration distance of the needle 10 into the food product. The needle fluid inlet 12 can be disposed in the top half of the food injection needle 10 and the fluid outlet port can be disposed in the bottom half or at the bottom of the food injection needle 10. There may be more than one needle fluid inlet 12 on food injection needle 10, and there may be more than one needle fluid outlet 14 on food injection needle 10 (shown in dotted lines). Further, the at least one needle fluid inlet 12 and the at least one needle fluid outlet 14 may be coaxially aligned on the injection needle 10 or may be circumferentially spaced apart from each other on the injection needle 10. Food injection needle 10 will have at least one needle fluid inlet 12 and one needle fluid outlet 14 such that fluid introduced into the at least one needle fluid inlet 12 will pass through the fluid bore 16 and out of the at least one needle fluid outlet 14.

Figure 3:
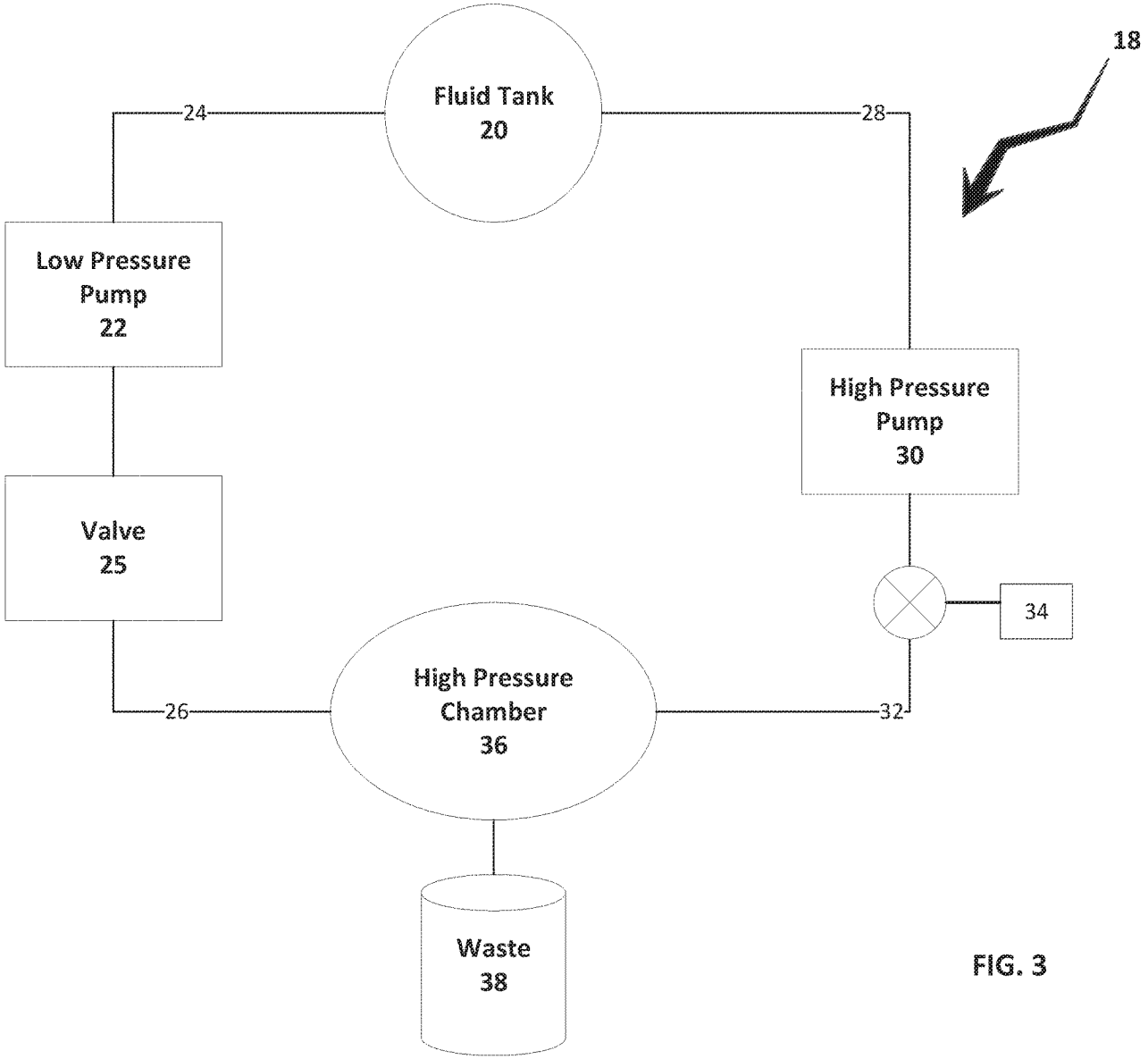
FIG. 3 shows a diagram of an embodiment of the inventive system.

FIG. 3 illustrates one embodiment of the system 18 that comprises at least one fluid tank 20 (some embodiments may comprise more than one fluid tank 20 (not shown)), a first fluid line 24 communicates cleaning fluid from the at least one fluid tank 20 to a low-pressure pump 22. A second fluid line 28 communicated cleaning fluid from the at least one fluid tank 20 to a high-pressure pump 30. A low-pressure fluid line 26 communicates low-pressure cleaning fluid from the low-pressure pump 22 to the high-pressure chamber 36. A valve 25 is preferably placed in the low-pressure fluid line 26 between the low-pressure pump 22 and the high-pressure chamber 36 to prevent backflow of high-pressure cleaning fluid from the high-pressure chamber 36 when the high-pressure pump 30 is actuated. A high-pressure fluid line 32 communicates cleaning fluid from the high-pressure pump 30 to the high-pressure chamber 36. A pressure gauge 34 may be placed in-line with the high-pressure pump 30 or the high-pressure fluid line 34 to allow for monitoring of the pressure output from the high-pressure pump 30. Cleaning fluid conveyed into the high-pressure chamber 36 and passes through the high-pressure chamber 36 and/or the injection needle 10 (not shown) is conveyed to a waste line 38 for either filtration and/or disposal.

In system 18, the at least fluid tank 20 is configured to hold and dispense a fluid cleaning solution to each of the first fluid line 24 and second fluid line 28. The cleaning solution may be, but is not limited to, a detergent, a sanitizer, biocide, and/or a cleaner such as citric acid, sodium hydroxide, vinegar, water, commercial sanitary solution, or a combination thereof. The fluid tank 20 comprises an opening or fluid tank inlet configured to receive the cleaning fluid, and an opening or fluid tank outlet configured to dispense cleaning fluid. In some embodiments, a multi-way valve (not shown) may be coupled to the fluid tank outlet, with backflow preventer valves, to regulate and control fluid flow out of the fluid tank 20 to the low-pressure line 24, to the second fluid line 28 and/or to the waste line 38 or for draining the fluid tank 20.

When communicating the cleaning solution along the second fluid line 28 from the fluid tank 20 to the high-pressure pump 30, some embodiments of the system 18 further comprise a cleaning solution pump 22 having a high-pressure backflow preventer. When the cleaning solution pump 22 is activated, the cleaning solution is pumped from the fluid tank 20 through the second fluid line 28 into the high-pressure pump 30.

The high-pressure pump 30 is configured pressurize the cleaning fluid and deliver the cleaning fluid at an increased flow rate through the high-pressure line 32 into the high-pressure chamber 36. Generally speaking, the increased pressure and flow rate are used to breakdown and dislodge debris stuck in the fluid bore 16 in the injection needle 10. A pressure gauge 34 aids in determining how much pressure is being applied to the fluid and what the impact on fluid flow rate and the system 18 itself. In some embodiments of the system 18 the high-pressure pump 30 may help achieve a maximum pressure of up to 7000 pounds per square inch ("PSI"). In other embodiments of the system 18 it is not recommended to increase the pressure beyond 4000 PSI. In some embodiments, the pressure may be as low as 25 psi. The pressure can range from 25 PSI to 7000 PSI, and can be any PSI in that range. The pressure range can be from 30 PSI to 6500 PSI, 35 PSI to 6250 PSI, 40 PSI to 6000 PSI, 45 PSI to 5725 PSI, 50 PSI to 5500 PSI, 55 PSI to 5000, PSI, 60 PSI to 4750 PSI, 65 PSI to 4500 PSI, 70 PSI to 4250 PSI, or 75 PSI to 4000 PSI. These ranges are not meant to be limiting and any pressure that effectively pushes the cleaning fluid through the fluid injection needle and effectively removes fluid substance residue and/or sanitizes the food injection needle after use will suffice. It is within the skill of one in the art to ascertain an acceptable level of cleaning and/or sanitizing the food injection needle after use.

Each of the low-pressure pump 22 and the high-pressure pump 30 may be a mechanical, electric, electromechanical, pneumatic or hydraulic pump. Most conventional electric, electromechanical, pneumatic or hydraulic pumps are self-priming. Where a non-self-priming pump is employed, a user manually primes the pump and pumps the fluid to a desired pressure and flow rate into and through the pump. A pressure gauge 34 may be employed in conjunction with either or both of the low-pressure pump 22 and/or the high-pressure pump 30. A control system (not shown) may also be employed to automatically monitor the fluid pressure in the high-pressure fluid line 32 and control high-pressure pump 30 based upon the monitored fluid pressures. This feed-back control monitoring allows for automatic control of the fluid pressure applied to the injection needles in the high-pressure chamber 36. The fluid pressure in the high-pressure fluid line 32 can be set to any desired pressure between 35 PSI and 7000 PSI, such as 4000 PSI, 4250 PSI, 4500 PSI, 4750 PSI, 5000 PSI or any pressure there between, and the high-pressure pump 30 will actuate and maintain pressure until it is shut off either under the control system or manually in response to either an over-pressure in the fluid line or a drop in pressure indicating that food injection needle 10 has been cleaned of debris.

Figure 4:
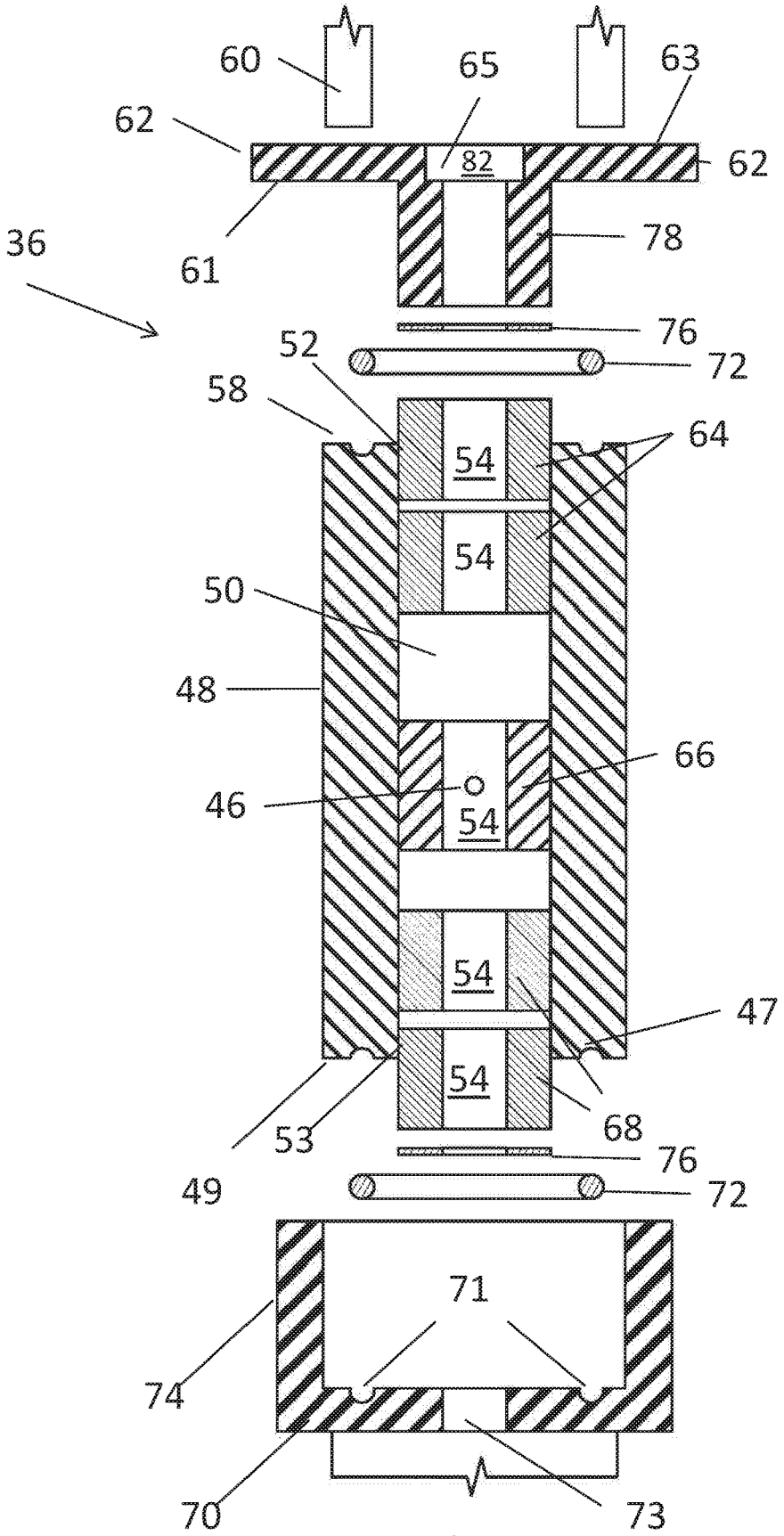
FIG. 4 shows an exploded cross-sectional of the high-pressure chamber.
Figure 5:
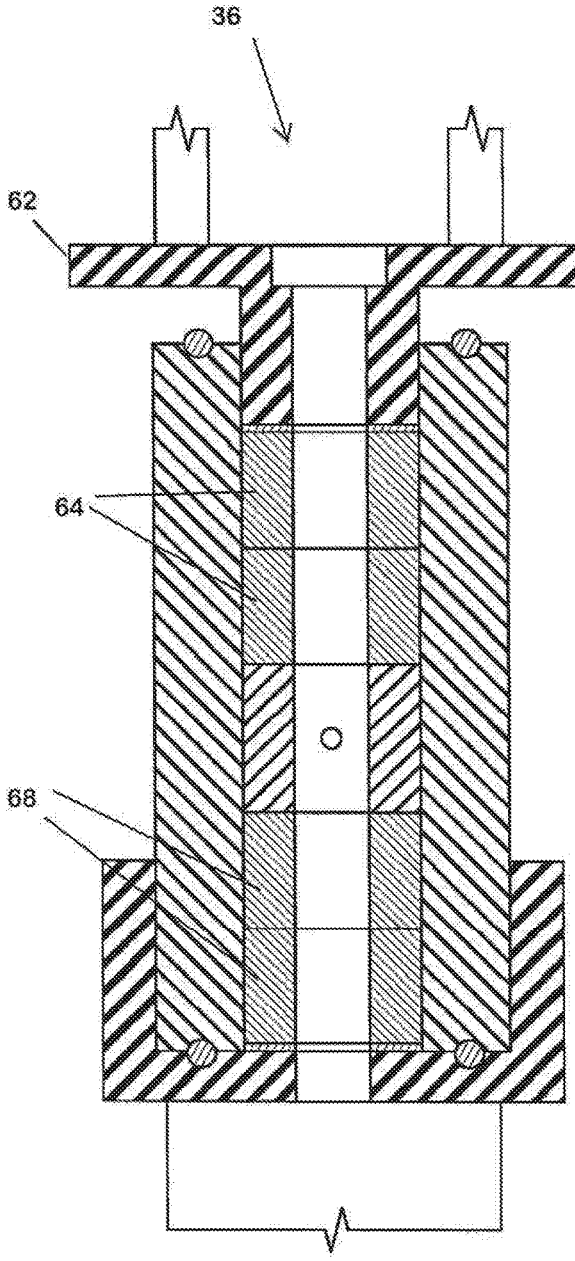
FIG. 5 shows an uncompressed cross-sectional of the high-pressure chamber.
Figure 6:
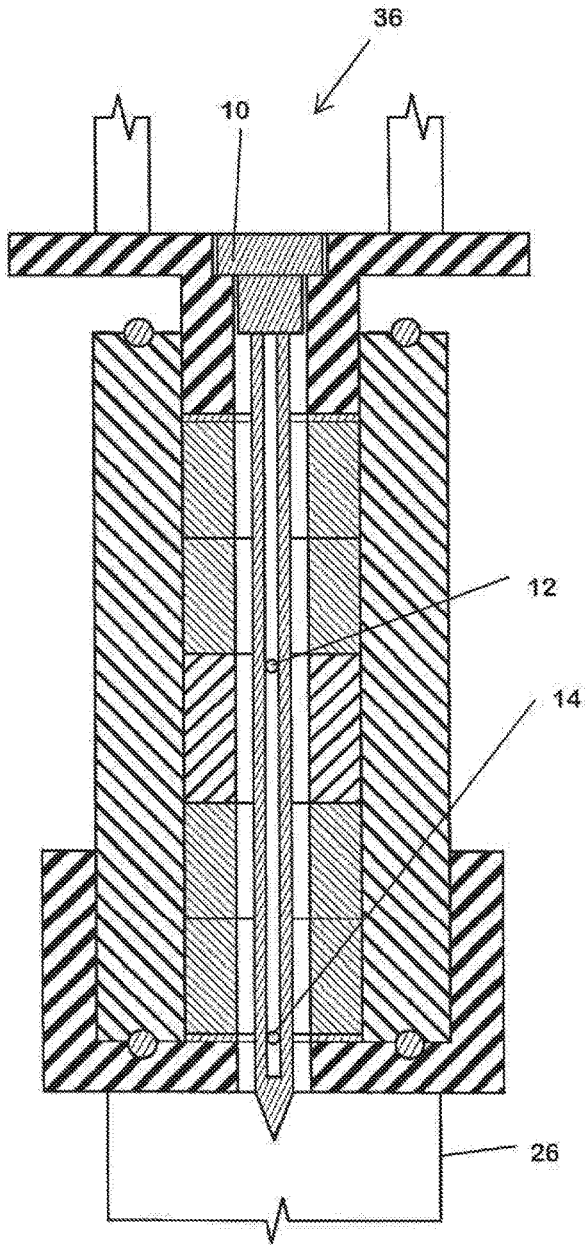
FIG. 6 shows an uncompressed cross-sectional of the high-pressure chamber with a food injection needle.
Figure 7:
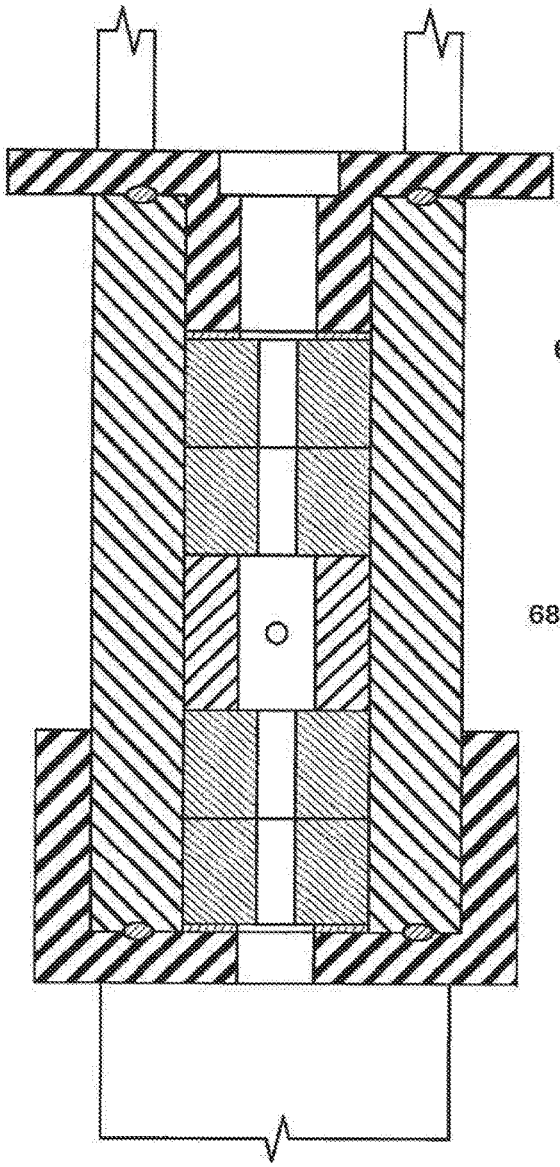
FIG. 7 shows a compressed cross-sectional of the high-pressure chamber.
Figure 8:
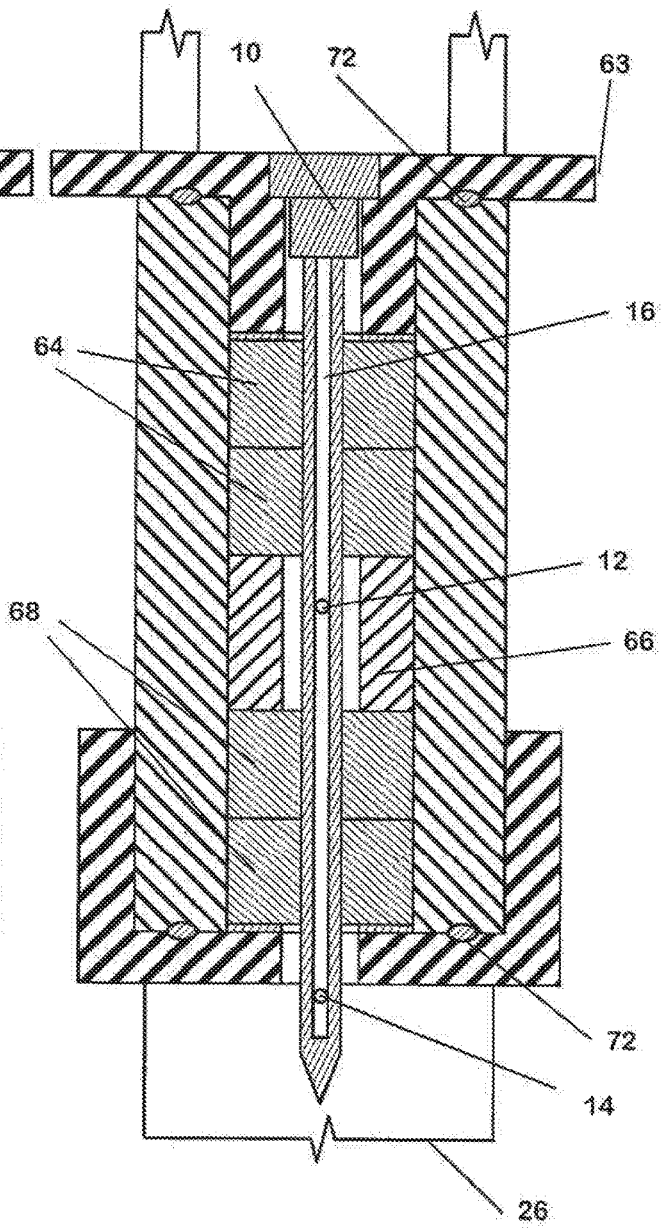
FIG. 8 shows a compressed cross-sectional of the high-pressure chamber with a food injection needle.
Figure 9:
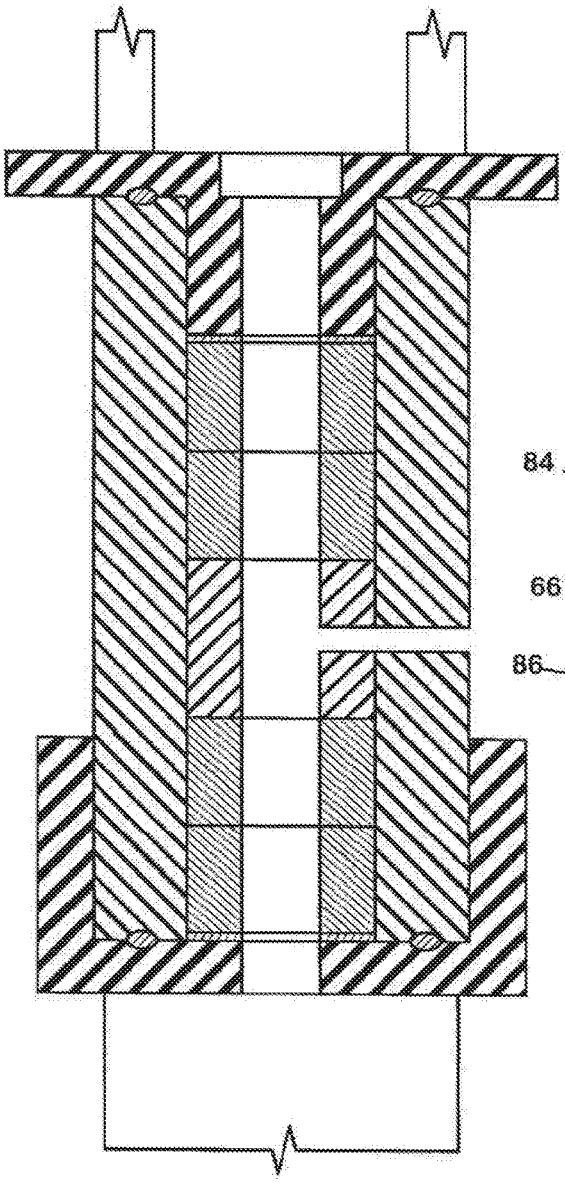
FIG. 9 shows a compressed cross-section of the high-pressure chamber.
Figure 10:
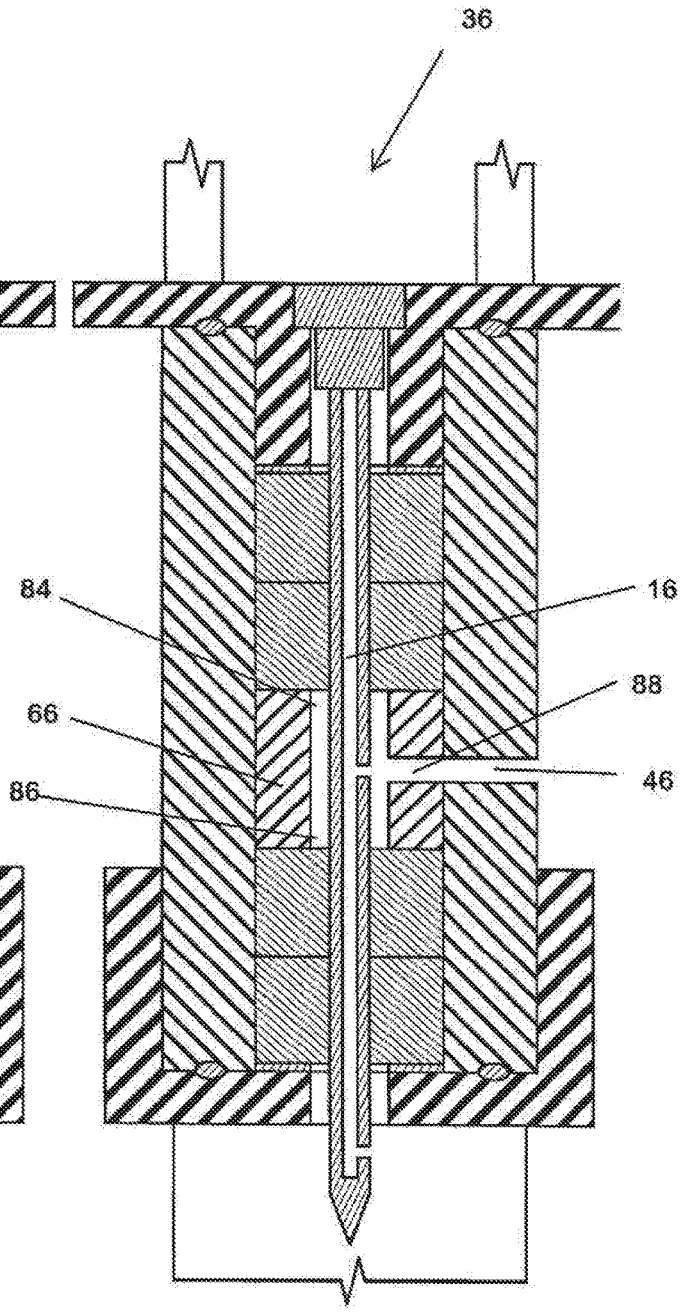
FIG. 10 shows a compressed cross-section of the high-pressure chamber with a food injection needle.

The high-pressure chamber 36, is further detailed in FIGS. 4-10. FIG. 4 shows the high-pressure chamber 36 in an exploded cross-sectional view, FIG. 5 and FIG. 6 show the high-pressure chamber 36 in an uncompressed state with and without at least one food injection needle 10 inserted. FIG. 7 and FIG. 8 illustrate the high-pressure chamber 36 in a compressed state with and without a food injection needle 10 inserted, while FIG. 9 and FIG. 10 illustrate the high-pressure chamber 36 in a compressed state with and without at least one food injection needle 10 inserted from at a cross-sectional through chamber fluid inlet 46.

The high-pressure chamber 36 generally comprises a chamber housing 48 having a central tubular bore 50 extending along a longitudinal axis of the chamber housing 48. The chamber housing 48 may have a single central bore 50 or may have plural central bores 50 formed in an external housing. In either case, the chamber housing 48 has an upper chamber opening 52 at an upper aspect of the chamber housing 48, a lower chamber opening 53 at a lower aspect of the chamber housing 48 and a cleaning fluid inlet 46 that passes laterally into a side aspect of the chamber housing 48 and communicates with the central bore 50. A high-pressure fluid line 32 (not shown) couples the cleaning fluid inlet 46 to the high-pressure pump 30, in FIGS. 3 and 4.

A pressing member 60, which may be a cam, a manual, hydraulic or pneumatic ram, or other similar member configured to apply pressure to drive and compress a needle receiver 62 into the upper chamber opening 52 when the handle is moved from an open to a closed position. It is to be understood by one of skill in the art that the pressing member 60 and handle assembly are merely a compression device to drive the needle receiver 62 into the upper chamber opening 52. Alternative embodiments may include any two-phase driving device that applies pressure on the needle receiver 62 in a first state and applies no or reduced pressure on the needle receiver 62 in a second state.

At least one first compressible annular spacer 64 is concentrically disposed within the central bore 50 at an upper end of the chamber housing 48. At least one second compressible annular spacer 68 is concentrically disposed within the tubular bore 50 at a lower end of the chamber housing 48. At least one incompressible annular spacer 66 is positioned concentrically within the tubular bore 50 and intermediate between the at least one first compressible annular spacer 64 and the at least one second compressible annular spacer 68.

In some embodiments, additional components may be added in place to aid in transferring pressure or providing a fluid seal within the chamber housing 48. Such additional components may a compressible seal 72, such as an O-ring, disposed upon or within the top surface 58 and/or a bottom surface 49 of the chamber housing 48. An end cap 74, which is preferably removably couplable to a lower portion of the chamber housing 48, allows for the at least one second compressible annular spacer 68 to bear against the end cap 74 when pressure is applied by the needle receiver. The end cap 74 has an outlet opening 73 aligned with the central bore 54 and is configured to receive the lower tapered end of the needle 10 and communicate waste fluid solution from needle fluid outlet 14 away from the chamber housing 48. A washer 76, having a central opening aligned with the central bore 54 may be interposed between a bottom surface of a lower compressible seal 68 and a lower inner surface of end cap 74. Alternatively, the lower compressible seal 68 may bear against the lower inner surface of end cap 74 when end cap 74 is coupled to chamber housing 48. The lower inner surface of end cap 74 may have an annular recess 71 configured to accept the seal 74 therein such that the seal 74 engages the lower inner surface of end cap 74 and a lower end surface 49 of the chamber housing 48. A corresponding annular recess 47 may be formed in the lower end surface 49 of the chamber housing 48 to accept seal 74, such that seal 74 seats in both the annular recess 47 and annular recess 71 to seal the end cap 74 to the chamber housing 48.

More particularly, the needle receiver 62 has an upper portion 63 and a lower portion 78. The upper portion 63 is configured with a needle receiving opening 65 in a central axis of the needle receiver 62. The needle receiving opening 65 extends into the lower portion 78 of the needle receiver 62 along the central axis of the needle receiver 62 and is coaxial with the central bore 54. The upper portion 63 of the needle receiver 62 is further configured with a radially projecting flange 61 configured to engage with pressing member 60. The lower portion 78 of needle receiver 62 movably engages with the central tubular bore 50 of the chamber housing 48 and bears upon the at least one first compressible annular spacer 64. At least one washer 76 may, optionally, be interposed between the lower portion 78 of the needle receiver 62 and the at least one first compressible member 64. Additionally, an upper compressible seal 72, such as an O-ring, may, optionally be provided on an upper end surface of the chamber housing 48 such that the projecting flange 61 of the needle receiver 62 bears upon the upper compressible seal 72 when the needle receiver 62 is fully engaged with the chamber housing 48.

In the foregoing configuration, pressing member 60 bears upon the flange 61 to transfer pressure to the needle receiver 62 and communicate a compressive force from the lower portion 78 of the needle receiver 62 to the at least one first compressible annular spacer 64, the at least one incompressible annular spacer 66 and the at least one second compressible annular spacer 68. The at least one first compressible annular spacer 64 and the at least one second compressible annular spacer 68 deform along their longitudinal and radial axes under the influence of the applied compressive force from the needle receiver 62 causing central bore 54 to narrow and seal against the needle 10, thereby sealing upper and lower surfaces of the needle 10. The incompressible annular spacer 66, is reciprocally movable within the central tubular bore 50 while maintaining fluid flow communication between the fluid inlet 46 of the chamber housing 48 and the needle fluid inlet 12, thereby communicating a fluid flow into the needle fluid inlet.

The needle receiver 62 further comprises a needle inlet 82 having a step-tapered diameter that allows the upper needle seat 11 of injection needle 10 to seat within the needle receiver 62 with the needle shank 13 projecting into and through the central bore 54 within the chamber housing 48. The needle inlet 82, in some embodiments, is configured to apply friction fit and seal around the food injection needle 10 or may be configured with threads to engage with threads on the upper needle seat 11 of the injection needle.

As used herein, the "annular" refers to a ring shape and is intended to encompass other substantially ring-shaped geometries, such as or irregular polygonal or elliptical opening shapes having an opening bound by the perimeter of that shape.

The at least one first compressible annular spacer 64 and the at least one second compressible annular spacer 68, as shown in FIGS. 4-10, are configured in an annular shape both having inner openings configured to compress and seal around a food injection needle 10 when in a compressed state. As detailed in the cross-sectional views in FIG. 8 and FIG. 10, the at least one first compressible spacer 64, when compressed, seals a portion of the food injection needle 10 above the needle fluid inlet 12. The at least one second compressible annular spacer 68, when compressed, seals a portion of the food injection needle 10 below the needle fluid inlet 12 and above the needle fluid outlet 14. The at least one incompressible annular spacer 66 defines an annular space 86 between an outer surface of the injection needle 10 and an inner annular surface of the at least one incompressible annular spacer 66 that permits fluid flow through the fluid inlet 46 and the at least one needle fluid inlet 12 and into the fluid bore in the injection needle 10. This arrangement allows all pressurized cleaning fluid to pass into the fluid bore of the injection needle 10 and out of the fluid outlet 14 of the injection needle 10 to clean and sanitize the injection needle 10, without leakage of the cleaning fluid around the at least one first compressible annular spacer 64 or the at least one second compressible annular spacer 68.

The at least one first compressible seal 64 and the at least one second compressible seal 68 are configured such that pressure exerted by actuation of the needle receiver 62 to bear upon the at least one first compressible seal 64 causes compression of the at least one first compressible seal 64 and bears upon and compresses the at least one second compressible seal 68 as well, thereby deforming the first 64 and second 68 compressible seals against the injection needle and sealing the needle shank 13 above and below the needle fluid inlet 12.

As shown in compressed states in FIGS. 7-8, When actuated by the pressing member 60 assembly, the annular portion 80 of the needle receiver 62 is driven by the pressing member 60 to seal against the housing top surface 74 and the tubular portion 78 of the needle receiver 62 is driven in the same direction along a central longitudinal axis into the tubular bore 50 of the chamber housing 48. A bottom portion the tubular portion 78 of the needle receiver 62 then provides a compressive force to the top compressible seal 64 directly or through a washer 76 disposed between the two components. The compressive force translates through the top compressible seal 64 to the at least one incompressible annular spacer 66 and through the at least one incompressible annular spacer 66 to the bottom compressible seal 68 to compress the bottom compressible seal 68 between the at least one incompressible annular spacer 66 and the bottom surface of the housing 70 or a washer disposed there between. The top compressible seal 64 and bottom compressible seal 68 may be comprised of a compressible material or elastic material. In some configurations the top compressible seal 64 or bottom compressible seal 68 may comprise a plurality of seals abutted against each other and configured to seal to one another when compressed.

The at least one incompressible annular spacer 66 as shown in FIG. 10 is a tubular shaped component comprising an upper opening 84, a lower opening, and fluid substance inlet 88. The upper inlet 84 and lower outlet 86 are configured to align with the openings within the first compressible annular member 64 and the second compressible annular member 68 when assembled into the tubular bore 50 allowing a portion of at least one food injection needle 10 with the needle fluid inlet 12 to be disposed within the at least one incompressible annular member 66. The fluid solution inlet 88, when disposed with the tubular bore 50, is configured to be aligned and fluidly coupled to the chamber fluid inlet 46 and fluidly coupled to the needle fluid inlet 12.

When cleaning solution is pumped into the high-pressure chamber through 36 through the housing cleaning fluid inlet 46 the fluid travels through the housing cleaning fluid inlet 46, through the fluid inlet 88, into the needle fluid inlet 12, through the fluid bore 16, and out the needle fluid outlet 14, through the outlet opening 73 in end cap 74 and into a waste line 38. The waste line 38 is then coupled to a cleanable or replaceable waste trap, waste water system, or sewage line.

In another aspect of the disclosure the high-pressure pump comprises a pressure sensor coupled to a control system that is configured to limit the high-pressure pump from outputting a fluid pressure beyond a preset pressure limit. In this aspect of the disclosure, the pressure sensor relays pressure data to the control system of a high-pressure electric pump, when a maximum pressure is reached, the control system limits the use of additional pressure or acts to maintain the set pressure. Alternatively, the pressure sensor may be a pressure relief valve having a pre-determined pressure rating at which the pressure relief valve will automatically open to release pressure in the high-pressure line 34.

A method of using the system 18 may comprise the following steps: inserting a food injection needle 10 into the upper chamber opening 52 such that the head of the food injection needle 10 bottoms out on the taper step, rotating the handle from an open position to a closed position driving the pressing member 60 to bear upon the needle receiver 62 and driving the annular portion of the plunger 80 to bottom out on the top surface of the high-pressure chamber 36, compressing the top compressible seal 64 and bottom compressible seal 68 with the needle receiver 62 causing the top compressible seal 64 and bottom compressible seal 68 to seal around the body of the food injection needle 10, filling the fluid tank 20 with cleaning solution, pumping the cleaning solution through a second fluid line 28 to a high-pressure pump 30 or to the high-pressure chamber 36, increasing the pressure and flow rate of the cleaning solution by activating the high-pressure pump 30 which pumps high-pressured fluid through the high-pressure line 32 and into a chamber housing cleaning fluid inlet 46, through the fluid inlet 88, through the needle fluid inlet 12, and through the fluid bore 16, out the needle fluid outlet 14, and through the waste line 38. Variations of this method may include powering the low-pressure pump to convey cleaning fluid out of the fluid tank 20, setting a flow rate or maximum pressure on a high-pressure pump such that the high-pressure pump stays active while debris is still detected inside the food injection needle 10, or priming a high-pressure pump before operation. Once the food injection needle 10 is cleared of debris and/or sanitized, and there decreased pressure in the high-pressure line 32, the low-pressure pump 22 may be actuated, either manually or automatically, to flush the high-pressure chamber 36 and the food injection needle 10 prior to removing the food injection needle 10 from the high-pressure chamber 36.

As depicted in FIGS. 8 and 10, during the cleaning cycle when the injection needle 10 is sealed within the at least one first compressible seal 64 and the at least one second compressible seal 68, the tapered end 15 of the injection needle extends into the outlet opening 73 that communicates with the waste line 38. The injection needle outlet 14 will be positioned past the at least one second compressible seal 68 such that fluid flow of the cleaning fluid may exit the injection needle outlet 14 and pass through the outlet opening 73 in end cap 74. Thus, the needle outlet opening 14 will be contained within either end cap 74 or within waste line 38 in such as manner to restrain the high-pressure cleaning fluid as it exits the injection needle outlet 14.

Figure 11:
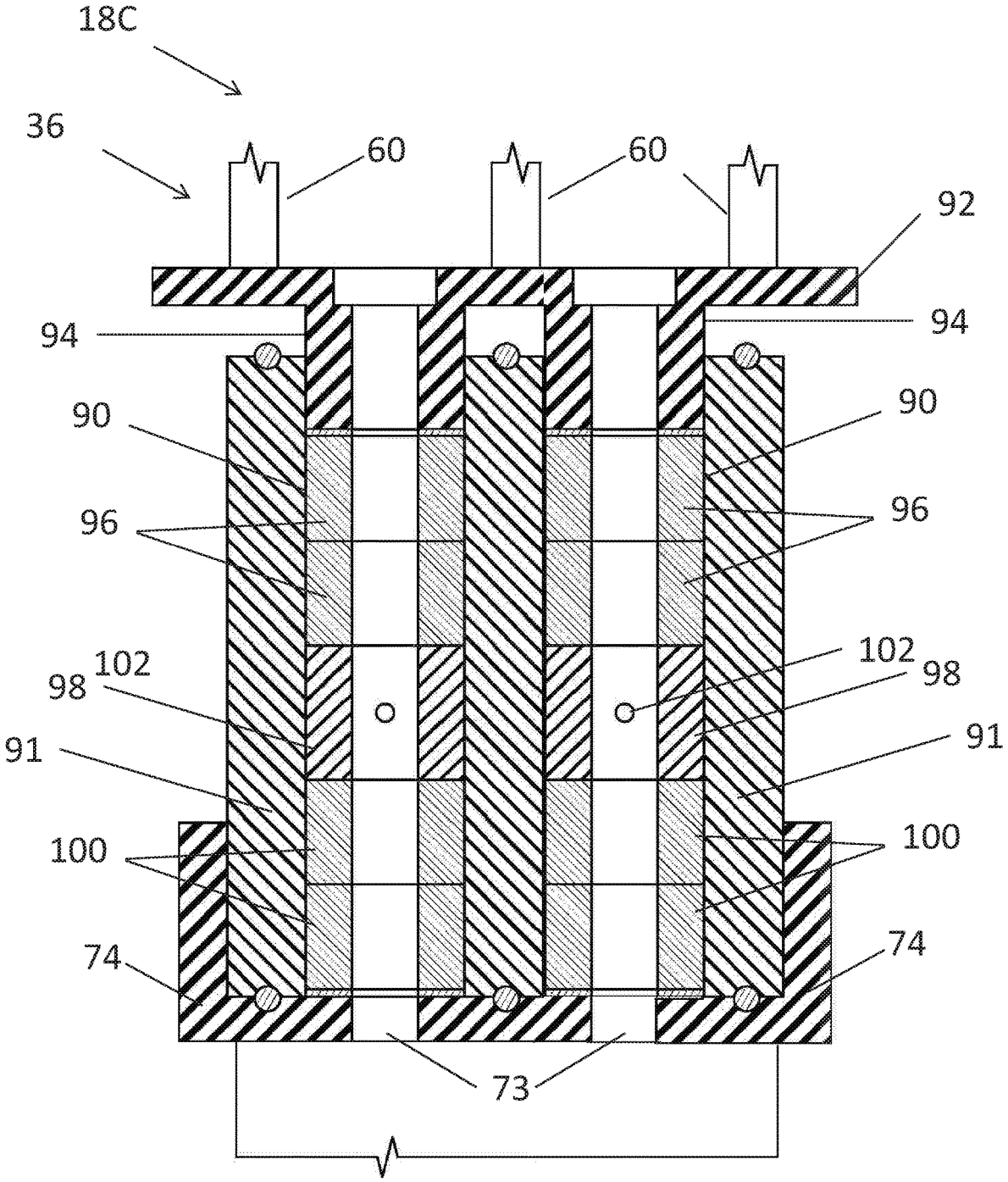
FIG. 11 shows a cross-section of a high-pressure chamber comprising a plurality of food injection needles.

In another embodiment of the system 18C shown in FIG. 11 the high-pressure chamber 36 has at least a two tubular bores 90 within a chamber housing 91, which may be a single chamber housing 91 or plural ganged housings 91, having a similar assembly configuration as the high-pressure chamber 36 described above. A needle receiver 92 is provided which may be a single member having plural tubular projections 94 or may be ganged members, each having a tubular projection 94. Within each of the at least two tubular bores 90 is disposed at least one first compressible annular seal 96, at least one substantially incompressible annular member 98 having a cleaning fluid inlet 102, and at least one second compressible annular seal 100, all in a stacked and co-axial alignment within the respective tubular bores 90. Each of the tubular projections 94 bear upon the at least one first compressible annular seal 96 in a manner similar to that described above with reference to FIGS. 4-10 when the needle receiver 92 is depressed under the influence of a pressing member 60. In this embodiment, at least one high-pressure fluid line is fluidly coupled to each of the cleaning fluid inlets 102 such that high-pressure fluid is conveyed into the cleaning fluid inlet 102 and into to the fluid inlet 12 of each of the fluid injection needles 10. Alternatively, a single high-pressure fluid line may couple the high-pressure fluid pump 30 to a manifold that distributes the high-pressurized cleaning fluid to plural cleaning fluid inlets 102 in the chamber housing 91. The manifold may be formed as an integral part of the chamber housing 91 or may be an external manifold coupled to the chamber housing 91 and the cleaning fluid inlets 102.

Another aspect of the disclosure may include a system having a plurality of high-pressure chambers and fluid lines dispensed from the fluid tank, or multiple fluid tanks, configured to clean multiple needles at the same time. In these embodiments, each chamber may be coupled to separate tanks and pumps operated in parallel. Alternatively each of the plurality of high-pressure chambers may be fluidly coupled to one or more manifolds that fluidly communicate with one or more cleaning fluid tanks and high-pressure and low-pressure pumps. Alternatively, plural fluid lines may be attached to each of the low-pressure and high-pressure pumps and pressurized fluid distributed to each respective chamber.

Finally, in order to assist a user in operating the system of the present invention, the high-pressure chamber housing 48, 91 may, optionally, be fabricated of a clear or substantially clear material, such as polycarbonate or glass, of a thickness and tensile strength sufficient to maintain its dimensional integrity under applied fluid pressures under which the system will operate, for example, up to 7000 PSI.

Those of ordinary skill in the art will understand and appreciate the foregoing description of the disclosure has been made with reference to certain exemplary embodiments of the disclosure, which describe a work light system and method of use. Those of skill in the art will understand that obvious variations in construction, material, dimensions or properties may be made without departing from the scope of the disclosure which is intended to be limited only by the claims appended hereto.

What is claimed is:

1. A food injection needle cleaning system, comprising:

A fluid tank containing a fluid substance;

A pump coupled to the fluid tank;

a chamber comprising at least one tubular bore passing through the chamber and a fluid substance inlet passing laterally into the tubular bore, the fluid substance inlet being in fluid flow communication with the pump;

a needle receiver movably engageable with a first opening of the tubular bore;

a first compressible annular member disposed within the tubular bore;

a substantially incompressible annular member disposed within the tubular bore and positioned such that the first compressible annular member bears upon the substantially incompressible annular member; the substantially incompressible annular member having a fluid substance opening passing laterally there through in fluid flow communication with the fluid substance inlet of the chamber;

a second compressible annular member disposed within the tubular bore and positioned such that the substantially incompressible annular member bears upon the second compressible annular member;

a waste opening passing through an end of the chamber;

a food injection needle coupled to the needle receiver and passing through the substantially incompressible member the first compressible annular member, the second compressible member; and a press member bearing upon the needle receiver to reciprocally move the food injection needle.

2. The food injection needle cleaning system of claim 1, wherein the pump further comprises a high-pressure pump.

3. The food injection needle cleaning system of claim 2, further comprising a first pump fluidly coupled to the high-pressure pump and to the fluid tank, and configured to convey fluid from the fluid tank, through the first pump and to the high-pressure pump.

4. The food injection needle cleaning system of claim 2, wherein the high-pressure pump is operably coupled to the press member, whereby actuation of the press member actuates the high-pressure pump.

5. The food injection needle cleaning system of claim 2, wherein the needle receiver further comprises an tubular member having a central bore passing through the tubular member, a radially extending flange projecting from an upper surface of the tubular member, wherein the central bore has a first diameter at an upper aspect of the central bore and a second smaller diameter and a lower aspect of the central bore and is configured to seat the injection needle within the upper aspect of the central bore.

6. The food injection needle cleaning system of claim 5, wherein the press member is operably coupled to the high-pressure pump, the press member configured to drive the needle receiver into the at least one tubular bore of the at least one chamber thereby compressing the first compressible annular member and one second compressible annular member against the food injection needle.

7. The food injection needle cleaning system of claim 2 wherein the high-pressure pump is a hydrostatic pump.

8. The food injection needle cleaning system of claim 2 wherein the high-pressure pump is configured to pressurize the fluid substance to a pressure between 25 PSI and 4000 PSI.

9. The food injection needle cleaning system of claim 2, further comprising a sensor and a control system configured to limit the fluid substance pressure to 5000 PSI.

10. The food injection needle cleaning system of claim 2, further comprising plural chambers each of the plural chambers having a tubular bore, each of the plural chambers being fluidly coupled to the fluid tank and a high-pressure pump.

11. The food injection needle cleaning system of claim 2, further comprising plural tubular bores.

* * * * *